United States Patent [19]

Martin

[11] 4,022,028

[45] May 10, 1977

[54] SUBMARINE PIPE TRENCHING APPARATUS

[76] Inventor: Charles F. Martin, 4814 Lotus St., Houston, Tex. 77045

[22] Filed: Dec. 23, 1971

[21] Appl. No.: 211,386

[52] U.S. Cl. ..... 61/72.4; 37/58; 37/63

[51] Int. Cl.[2] ..... E02F 5/08

[58] Field of Search ..... 61/72.4, 72.1; 37/50, 37/63, 81, 86

[56] References Cited

UNITED STATES PATENTS

| | | | |
|---|---|---|---|
| 2,879,649 | 3/1959 | Elliott | 61/72.4 |
| 3,004,392 | 10/1961 | Symmank | 61/72.4 |
| 3,338,059 | 8/1967 | Tittle | 61/72.4 |
| 3,429,132 | 2/1969 | Martin | 61/72.4 |
| 3,583,170 | 6/1971 | DeVries | 61/72.4 |
| 3,590,589 | 7/1971 | Smulders | 61/72.4 |
| 3,670,514 | 6/1972 | Breston et al. | 61/72.4 |

*Primary Examiner*—Jacob Shapiro

*Attorney, Agent, or Firm*—Browning, Bushman & Zamecki

[57] ABSTRACT

Submarine pipe trenching apparatus for digging a trench below submarine pipelines, wherein a pair of trench cutter assemblies are mounted for digging themselves into the ground from a substantially horizontal position alongside the pipe to an upright position below the pipe, and wherein a crawler assembly is mounted on the pipe for moving the cutter assemblies along and below the pipe when the cutter assemblies are operated for digging out the soil below the pipe. The crawler assembly is constructed so that the lateral bends and vertical undulations in the pipe are detected and means are provided for stabilizing and re-positioning the cutter assemblies as necessary to maintain them in their upright cutting position below the pipe regardless of such bends and undulations. The cutter assembly may have rotating blades or jets for the cutting action, with each cutter assembly disposed at a trailing angle to provide clearance between the bottom and each cutter assembly.

38 Claims, 18 Drawing Figures

Charles F. Martin
INVENTOR

BY

Pravel Wilson & Matthews
ATTORNEYS 50e
16b
51
65a
50d
50b
67
10
10e
10d
10a
50f
16a
16
B
14
62
61
61b
60
65
44
21e
72
65b
46
72b
12
10b
12b
15
73
11
12a
11a
15a
67b
50c
P 16b
16
16a
73
72
10
67
61b
61a
65b
46
10d
B
14
12b
65
11
10e
12
21a
20d
19
18a
18
61
60b
60
61c
21d
21c
10a
10b
17f
60a
19
21
5
22
6
20b
22c
17
17h
40
37a
17h
18
D
22b
17g
18a
60c
62
17b
D
17g
P
17b
17e
50
17g
5
6
C
9
9
Charles F. Martin
INVENTOR
BY
Pravel Wilson & Matthews
ATTORNEYS Charles F. Martin
INVENTOR

BY

Prawel Wilson & Matthews
ATTORNEYS

Fig. 8
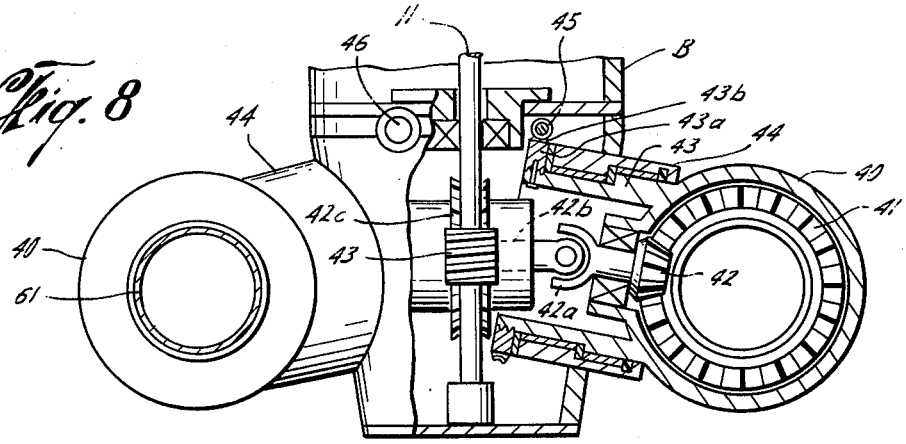
Fig. 9
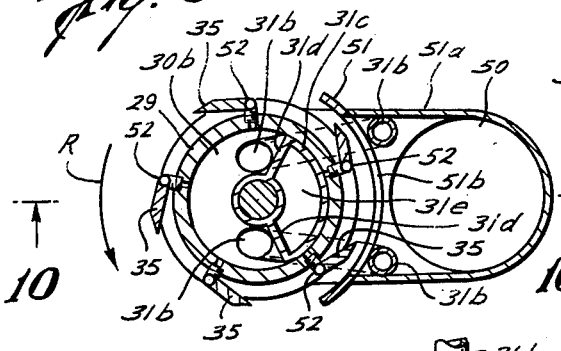
Fig. 11
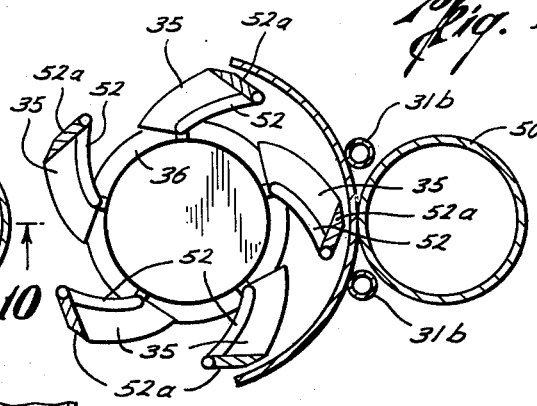
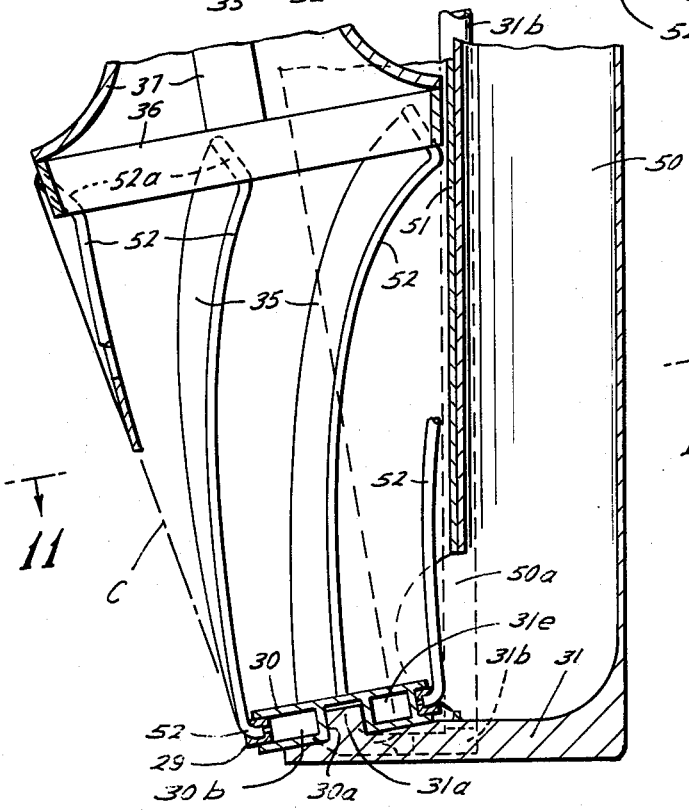
Fig. 10
Charles F. Martin
INVENTOR
BY
Pravel Wilson & Matthews
ATTORNEYS Charles F. Martin
INVENTOR

BY

Prowel Wilson & Matthews
ATTORNEYS

Fig. 14
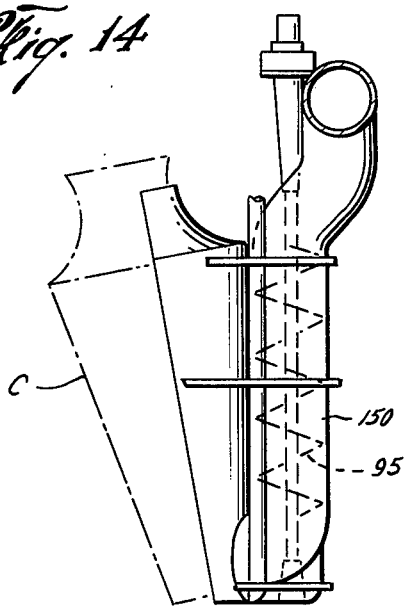
Fig. 15
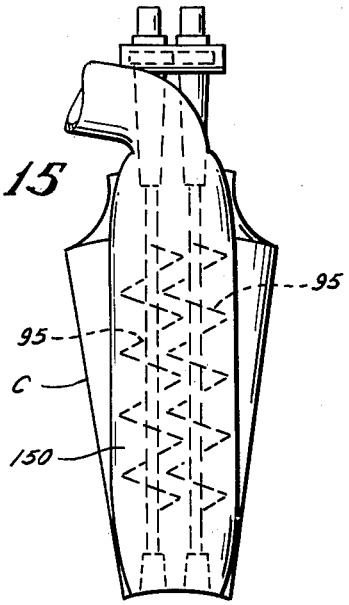
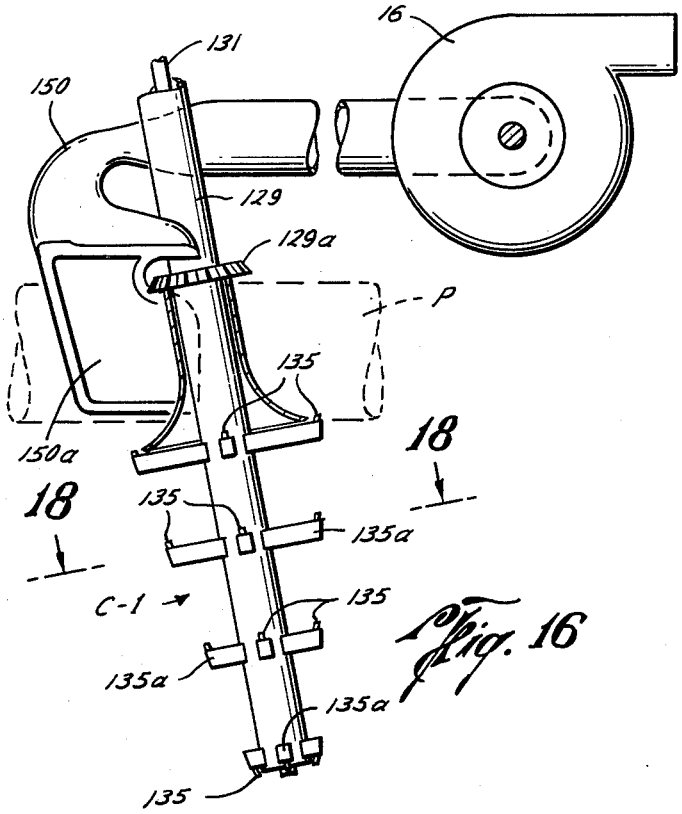
Fig. 16
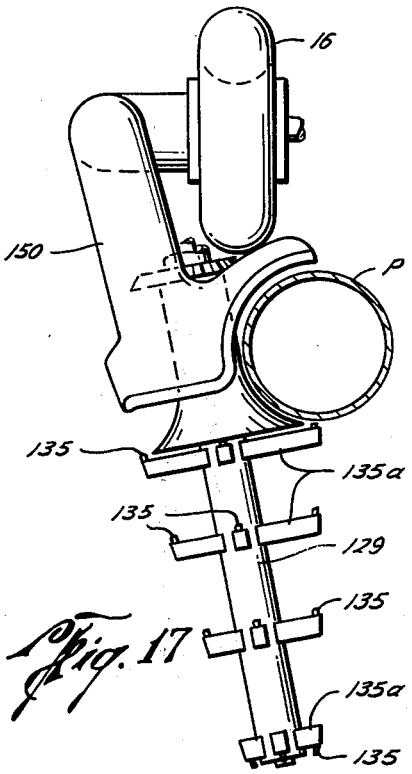
Fig. 17
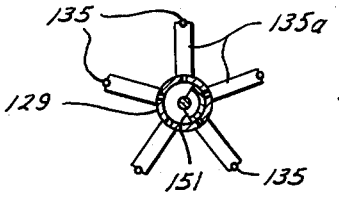
Fig. 18
Charles F. Martin
INVENTOR
BY
Prowel Wilson & Matthews
ATTORNEYS

SUBMARINE PIPE TRENCHING APPARATUS

BACKGROUND OF THE INVENTION

The field of this invention is submarine pipeline trenching apparatus.

Apparatus is presently known for digging a trench below a pipeline, examples of which are U.S. Pat. Nos. 3,429,131 and 3,429,132 granted to Charles F. Martin. With such prior patents it was necessary to pre-form or pre-dig a hole below the pipeline in the ocean bottom for receiving the cutter assembly or assemblies so that the apparatus could be mounted on the pipeline in its operable digging position. Additionally, difficulty was sometimes experienced in use due to shifting and other instability of the apparatus as it moved along the pipeline because of lateral bends and vertical undulations. Dragging of the lower ends of the cutters along the bottom of the trench often interfered with the cutting action and rapid longitudinal travel of the cutters relative to the pipeline.

SUMMARY OF THE INVENTION

The present invention relates to new and improved apparatus for digging a trench below a pipeline in the bottom of an ocean or other body of water so that the portion of the pipeline behind the apparatus will thereafter progressively drop into the trench. The apparatus has a pair of cutter assemblies, each of which is adapted to dig itself into the bottom, whereby the apparatus may be mounted on the pipeline with the cutter assemblies in the raised position and then the cutter assemblies may be operated to dig into the bottom to the upright trench cutting position. The apparatus is stabilized and is limited in its shifting due to lateral bends and vertical undulations. Each cutter assembly is disposed with its lower end inclined at a trailing angle with respect to the upper end thereof to minimize and substantially eliminate drag on the cutter assemblies during their trench cutting action and longitudinal movement relative to the pipeline.

BRIEF DESCRIPTION OF THE DRAWINGS

FIG. 8 is a view taken on line 8—8 of FIG. 1 to illustrate details of the mechanism for moving each cutter assembly from a substantially horizontal position alongside the pipeline to a substantially upright position below the pipeline;

FIG. 9 is a view taken on line 9—9 of FIG. 3;

FIG. 10 is a view taken on line 10—10 of FIG. 9;

FIG. 11 is a view taken on line 11—11 of FIG.10;

FIG. 14 is a side view of a modified cutter assembly having additional spoil remover means therewith;

FIG. 15 is a rear view of the modified cutter assembly shown in FIG. 14;

FIG. 16 is another modification of the cutter assembly and the spoil removal means therewith, wherein a plurality of jets are utilized for digging the trench below the pipeline;

FIG. 17 is a front view of the modified cutter assembly of FIG. 16, but showing the opposite cutter assembly to that shown in FIG. 16; and FIG. 18 is a sectional view taken on line 18—18 of FIG. 16.

DESCRIPTION OF THE PREFERRED EMBODIMENTS

Figure 1:
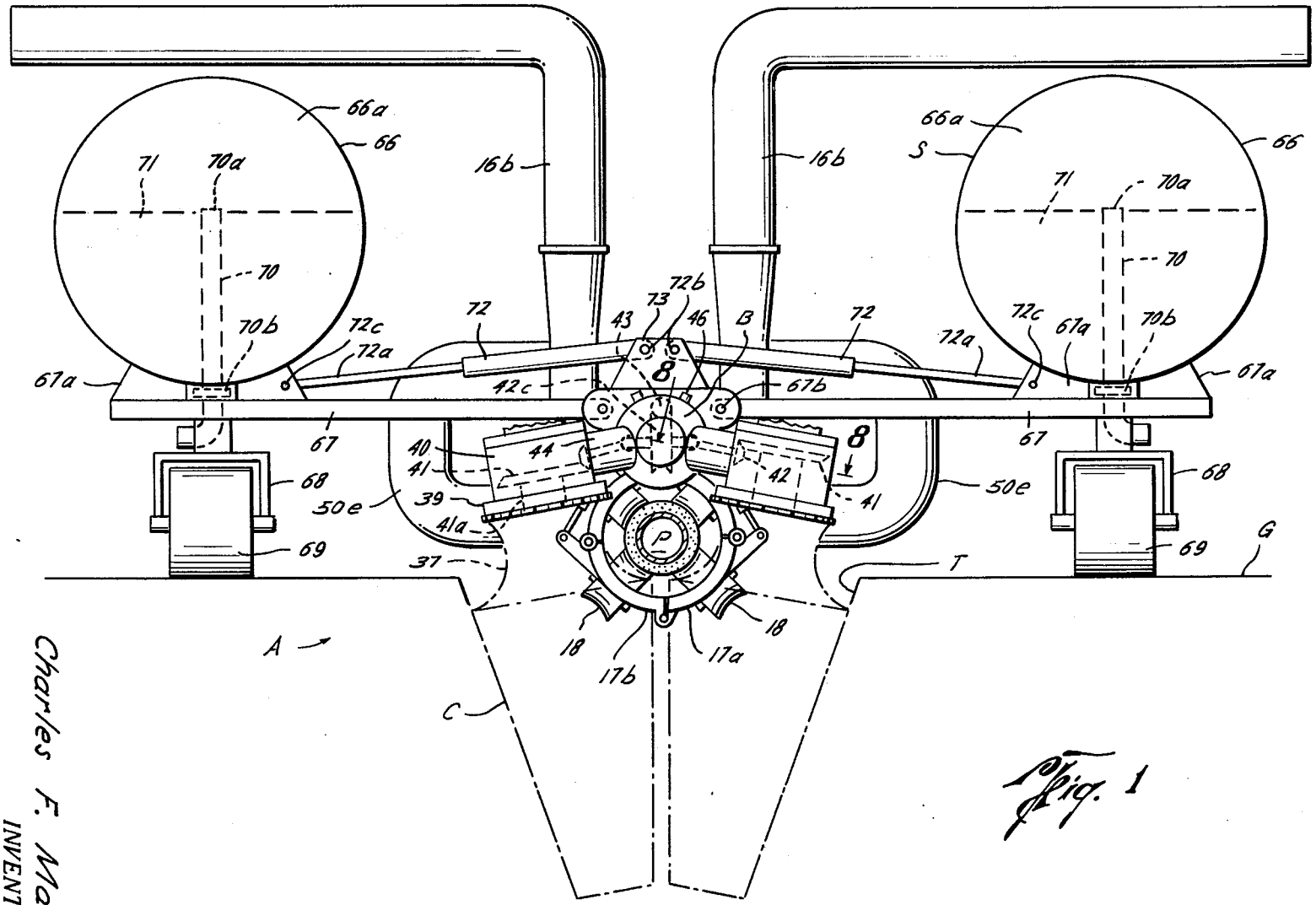
FIG. 1 is a front view of one embodiment of the apparatus of this invention, showing the pair of cutter assemblies in trench digging position.

In the drawings, the letter A designates generally the form of the invention illustrated in FIGS. 1–11 which basically has a body B to which are mounted a pair of cutter assemblies C which are adapted to be positioned below a pipeline P for cutting a trench T therebelow. A pair of pipe crawler assemblies D are mounted with the body B for imparting longitudinal movement to the apparatus A relative to the pipeline P to thereby longitudinally move the cutter assemblies C for cutting the trench T as each of the cutter assemblies C is rotated about its own axis. Stabilizing means S is provided with the apparatus A for maintaining the cutter assemblies C in their substantially upright position while cutting the trench T, despite bends and undulations in the pipeline P.

Figure 2:
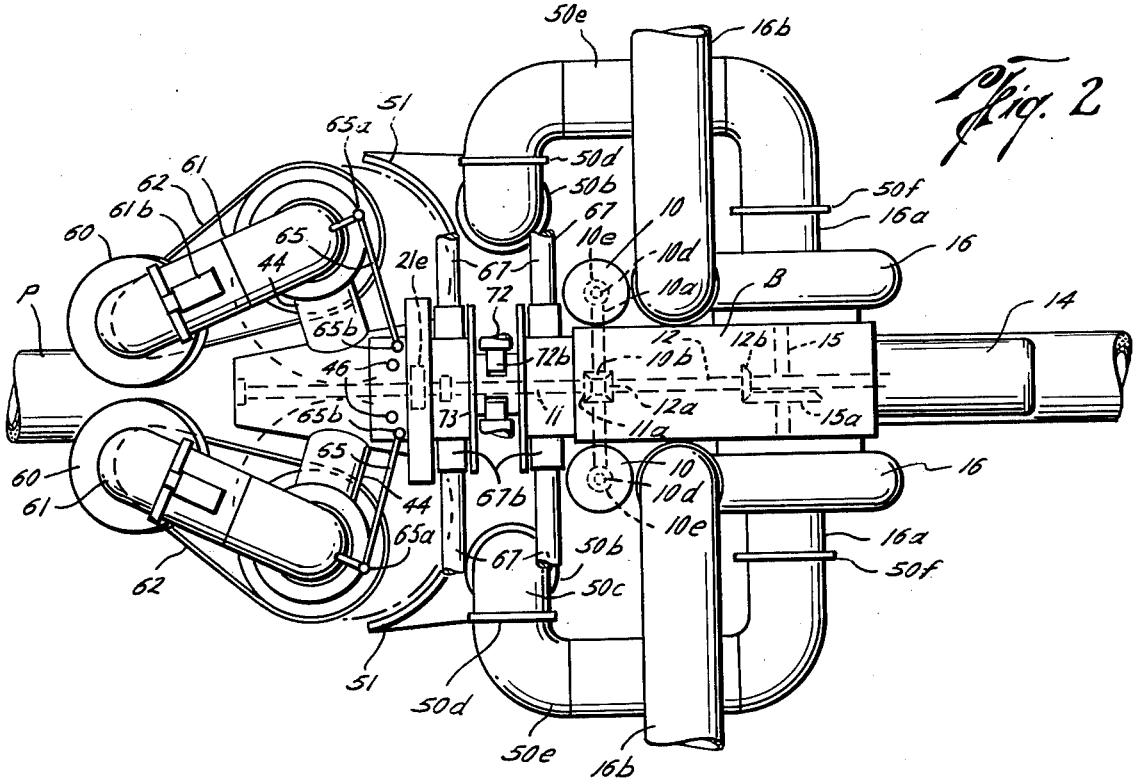
FIG. 2 is a plan view of the form of the invention illustrated in FIG. 1, and showing the cutter assemblies in trench digging position on a pipeline.
Figure 3:
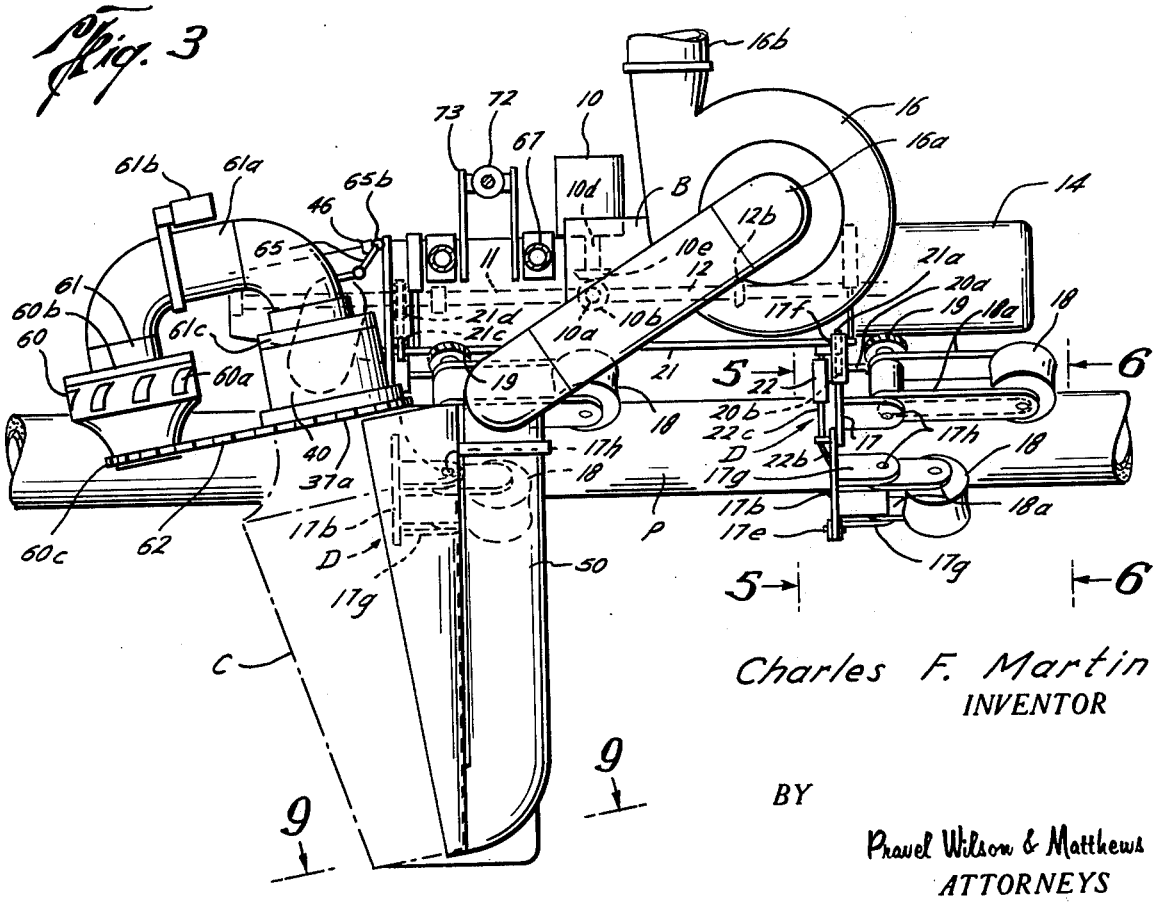
FIG. 3 is a side view of the apparatus of FIG. 2, showing further details of the embodiment of FIGS. 1 and 2.

Considering the invention more in detail, the body B is generally cylindrical in shape and is disposed above the pipeline P during the operation of the apparatus A, as will be more evident hereinafter. One or more motors 10 of any suitable type, such as a water driven turbine, electric motor, or hydraulic motor, are disposed on opposite sides of the body B and are secured thereto in any suitable manner. The motors 10 may be mounted in any suitable arrangement to provide power to the central forward shaft 11 and the central rearward shaft 12. By way of example, as seen in FIGS. 2 and 3, each motor 10 has a vertically extending shaft **10*d* with a gear 10*e* driving a horizontally extending shaft 10*a* having a gear 10*b* thereon. The gears 10*b* which are driven by the motors 10 are in meshing engagement with a gear 11*a* on the forward shaft 11 and a gear 12*a* on the rearward shaft 12. The rearward shaft 12 extends to an auxiliary motor or hydraulic system 14 secured to the body B by any suitable manner. Also, the shaft 12 has a gear 12*b* meshing with a gear 15*a* on a shaft 15 which extends to conventional spoil removal centrifugal pumps 16 mounted at the rear end on the sides of the body B (FIGS. 2 and 3). Each of the spoil removal pumps 16 has an inlet pipe 16*a* and an outlet pipe 16*b*** for the intake and discharge of the spoil from the trench T being cut, as will be more evident hereinafter.

The forward central shaft 11 is mounted for providing power for two purposes in the form of the invention shown in FIGS. 1–11. First, the shaft 11 supplies power for rotating the cutters C and it also provides power for the pipe crawler assemblies D to move the apparatus A longitudinally along the pipe P, as will be explained in detail.

Each of the pipe crawler assemblies D is preferably identical, so that both may be driven for impelling the apparatus A along the pipeline P. However, normally only the forward pipe crawler assembly D is supplied with driving power but to clarify the description, the specific details of the crawler assembly D at the rear of the apparatus A (FIG. 3) is specifically described since it is more visible in the drawings. It will be understood that only the forward crawler assembly D may be provided with the power, but essentially, the arrangement for supplying the power to either crawler assembly D is the same and therefore the description which follows hereinafter for the rear pipe crawler assembly D applies to both of such assemblies D.

Referring now in particular to FIGS. 3, 5, 6 and 7, the pipe crawler assembly D includes an upper semi-circular bracket 17 and a pair of quarter section brackets 17*a* and 17*b* which are pivotally joined to the upper bracket 17 at pivot points 17*c* and 17*d*. The lower brackets 17*a* and 17*b* are adapted to pivot about the pivot points 17*c* and 17*d* to open same to a width to permit the crawler assembly D to pass over the pipeline P and then, the sections 17*a* and 17*b* are adapted to be fastened together by any suitable pin connector 17*e* or similar connecting means, manually or mechanically applied. The upper bracket 17 has a support plate 17*f* welded or otherwise secured thereto. A pair of bracket arms 17*g* are provided for each of a plurality of rollers or wheels 18 which are mounted for engagement with the external surface of the pipeline P. Preferably, all of the rollers 18 are pivotally mounted on the bracket arms 17*g* by a pivot pin 17*h* or similar connecting means. The pins 17*h* extend to and are connected with wheel brackets 18*a*, preferably on each side of each wheel 18. It is to be noted that the lower wheels 18 preferably use shorter brackets 18*a* than the upper wheels 18 (FIG. 3).

Figure 7:
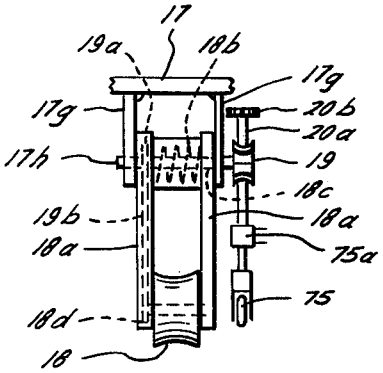
FIG. 7 is a view taken on line 7—7 of FIG. 6 to illustrate further details of the pipe crawler assembly shown in FIG. 6.
Figure 6:
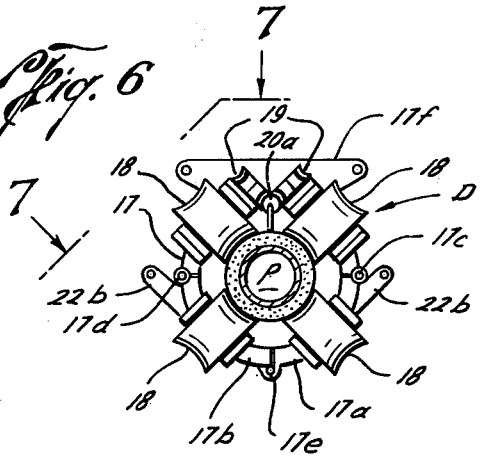
FIG. 6 is a view taken on line 6—6 of FIG. 3 to further illustrate details of one of the pipe crawler assemblies.

All of the wheels 18 are urged radially into constant engagement with the external surface of the pipeline P by a conventional rotary hydraulic actuator or by a coil spring, such as the spring 18*b* illustrated in the drawings (FIG. 7). Such spring or hydraulic actuator exerts a predetermined torque or force on the wheel brackets 18*a* to urge the wheels 18 constantly in a direction towards the pipeline P to maintain contact therewith at all times, while permitting flexibility or movement with respect thereto for automatic adjustments in response to surface undulations or variations on the pipe coating or other external surface of the pipeline P. Also, when the apparatus A is shifted by other means, as will be more evident hereinafter, the controlled pivotal movement of the rollers or wheels 18 permits an adjustment in the position of the apparatus A to maintain the cutter assemblies C in their proper cutting position below the pipeline P.

Figure 5:
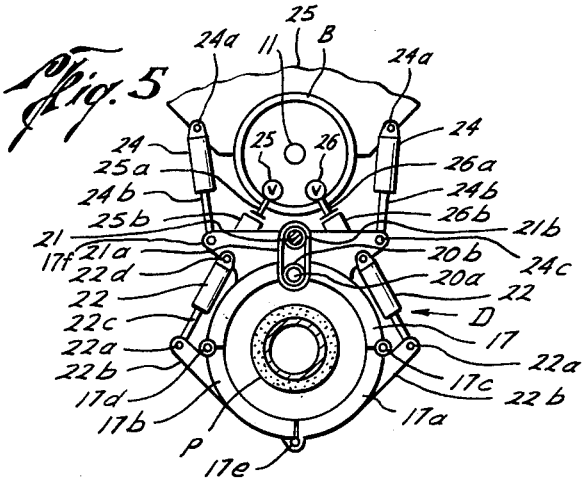
FIG. 5 is a view taken on line 5—5 of FIG. 3 to illustrate certain details of one of the pipe crawler assemblies.

For imparting power to the upper rollers 18 for driving the apparatus longitudinally of the pipeline P, a drive shaft 18*c* extends from a worm gear 19 to a sprocket 19*a* on the other end of the shaft 18*c* which is operably connected with a chain 19*b* extending to a sprocket 18*d* connected to the wheel 18. The worm gear 19 is driven by a worm 20 (FIG. 6) on shaft 20*a* which has a sprocket 20*b* thereon which is driven by a chain 21*a* in engagement with a sprocket 21*b* on a lower drive shaft 21 (FIGS. 3 and 5). The shaft 21 is mounted in any suitable bearings (not shown) and it extends forwardly from the sprocket 21*b* to a similar sprocket 21*c* which is driven by a chain 21*d* (FIG. 3) engaged with a sprocket 21*e* on the forward drive shaft 11. In the event only the forward pipe crawler assembly D is powered, the shaft 21 may be omitted and the drive is then directly from the shaft 11 through the sprocket 21*e*, chain 21*d* and sprocket 21*c* to the shaft 20*a* therebelow in the same manner as described for the rear assembly D. To facilitate the opening and closing of the brackets 17*a* and 17*b*, hydraulic cylinders 22 which are pivotally connected at 22*a* to brackets 22*b* on the brackets 17*a* and 17*b* are utilized. The hydraulic cylinders 22 are actuated in any known manner, by providing hydraulic fluid to either end of such cylinders for moving the piston rods 22*c* therewith in the known manner for opening and closing the brackets 17*a* and 17*b* when the retaining or locking pin 17*e* has been removed. The upper end 22*d* of each cylinder 22 is preferably pivotally connected to the support brackets 17*f*.

As best seen in FIG. 5, a pair of hydraulic or fluid actuated control cylinders 24 are mounted with their upper ends pivotally attached at 24*a* to a body plate 25 which is welded or is otherwise secured to the body B. The precision rod 24*b* with each cylinder 24 is pivotally connected at 24*c* to the support brackets 17*f*. Control valves 25 and 26 are suitably mounted in the body B with actuating stems 25*a* and 26*a* extending therefrom for engagement with fixed stop members 25*b* and 26*b*, respectively, when the cutter assemblies C tend to shift in either direction due to lateral bends in the pipeline P. Thus, as will be more evident hereinafter, in the event there is a lateral bend towards the left in the pipeline P, there is a tendency for the piston rod 24*b* in the left cylinder 24 (FIG. 5) to move upwardly to shorten the length of the piston rod 24*b* which is exposed, thereby shortening the distance from the pivot point 24*a* to the pivot point 24*c* for the left-hand cylinder 24 as viewed in FIG. 5. Simultaneously, the piston rod 24*b* is extended for the right-hand cylinder 24, and when the shift is sufficient to cause the valve rod 25*a* to contact the stop 25*b*, the valve 25 is actuated to direct hydraulic fluid to the left-hand cylinder 24 and from the right-hand cylinder 24 so that the cylinders 24 return to their normal positions shown in FIG. 5, wherein the distances from the upper pivot point 24*a* to the lower pivot point 24*c* for each of the cylinders 24 is substantially the same. The return of the cylinders 24 to the normal position also returns the body B to is normal position, together with the cutter assemblies C which are mounted therewith, as will be more evident hereinafter. It should be noted that portions of the forward pipe crawler assembly D have been omitted in the view shown in FIG. 1 for the purposes of clarity in that view, but the details thereof are fully disclosed in FIGS. 3, 5, 6 and 7.

Considering now the details of each cutter assembly C, and particularly as shown in FIGS. 8–11, it should be noted that each cutter assembly C is substantially identical to the other except that they are rotated in an opposite direction, each about its own axis. Therefore, for the most part, only the details of one of the cutter assemblies C is described hereinafter since such details will apply to the other cutter assembly C as well. The actual details of the cutter assembly D may be identical to each cutter assembly illustrated in said U.S. Pat. No. 3,429,132, but preferably each assembly D is modified as compared to the cutter assemblies of such prior patent, as will be more evident hereinafter. Thus, each cutter assembly C is formed with a base ring 29 which is mounted for rotation relative to and in a water distribution base support 30 having a recess 30*a* therein for receiving a post 31*a* on a base 31. The base support 30 does not rotate but is held stationary with the base 31 while the ring 29 rotates relative thereto. Suitable bearings and/or water tight seals are provided between the ring 29 and the engaging surfaces forming the guide track and support in the base 30. The base 30 has a fluid chamber 30*b* formed therein for receiving water or other fluid for jetting purposes, as will be more evident hereinafter, and for this purpose, such chamber 30*b* is in communication with one or more inlet tubes or passages 31*b* which extend to a suitable source of water or liquid, which may either be located with the apparatus A or at a point remote therefrom. A shield 31*c* is formed with the base 30 and it has a connector plate 31*d* therewith so as to form a closed section 31*e* of the chamber 30*b* into which the water from the chamber 30*b* does not enter for thereby controlling the jetting action with the cutter assembly C, as will be explained.

The base 29 has a plurality of curved cutter blades 35 welded or otherwise affixed thereto and extending upwardly as best seen in FIG. 10 to a location in proximity to an annular upper ring 36 to which the upper end of each cutter blade 35 is also welded or otherwise secured. A plurality of contoured upper ribs 37 are also connected to the annular ring 36 and they extend upwardly and are secured to a bearing ring 39 shown in FIG. 1. The bearing ring 39 is supported on a tubular cutter support 40, the construction and mounting of which is illustrated in detail in FIGS. 1 and 8, and which will be described more in detail hereinafter.

For rotating each cutter assembly C, any suitable drive means is provided such as an annular beveled gear 41 which is connected by a pipe or other suitable means 41*a* to the upper ring 39 so that when the gear 41 is rotated, the entire cutter assembly C therebelow is rotated about its own axis. It is to be noted that the beveled gear 41 in the right-hand position of FIG. 1 is located at a higher elevation than the bevel gear 41 in the left-hand position shown in FIG. 1, the purpose of which is to accomplish opposite rotation of the cutter assemblies C with respect to each other to offset any torque effect from such rotation on the rest of the apparatus. The drive mechanism for driving the gear 41 shown in the right position of FIG. 1 is illustrated in detail in FIG. 8, and it will be understood that the same drive mechanism is utilized for the gear 41 on the left position of FIG. 1. Thus, the gear 41 meshes with a pinion gear 42 which is connected through a universal joint 42*a* to a shaft 42*b* having a gear 42*c* mounted therewith and operably connected to a worm 43 on shaft 11, which as previously explained, is driven by one or more of the motors 10. It should be noted that the gear teeth on the gear 41 shown in FIG. 8 appear to be below the pinion gear 42, but the relationship of the gears 41 and 42 for the right-hand cutter assembly C is actually that illustrated in FIG. 1. It should also be understood that although the single gear 42*c* is illustrated, a plurality of gears may be utilized in a gear box for determining the speed of rotation of the cutter assemblies C by the gear ratios thereof.

Although the housing or support 40 does not rotate as a result of the driving of the gear 41, such housing 40 may be rotated within predetermined limits for moving the cutter assembly C from a position substantially along side a pipeline P, or substantially horizontal (FIG. 4) to the substantially upright digging position of FIGS. 1 and 3. Also, the reverse movement may occur to return the cutter assemblies C from the digging position of FIG. 3 to the retracted position of FIG. 4. For accomplishing such movement of the housing 40, a sleeve 43 is formed integrally or is connected to one side of the housing 40 and it extends into a guide sleeve 44. A gear ring 43*a* having worm gear teeth 43*b* thereon is mounted in operable engagement with a worm 45 which is rotated by a suitable separate power means such as a small electric or fluid motor 46 mounted at the forward end of the body B. When the motor 46 is operated to rotate the worm 45, it turns the gear 43*a* and the sleeve 43 therewith relative to the guide sleeve 44 which is welded or is otherwise secured to the body B. The motors 46 may be relatively small and they require only a small amount of power because the cutter assemblies C are actually rotated as they are moved from the retracted substantially horizontal position along side the pipeline and this effects a digging of the soil by the cutter assemblies as they move downwardly to their substantially upright trench cutting position of FIG. 3. Thus, the cutter assemblies C tend to dig themselves into the cutting position from the retracted position and therefore the motors 46 merely assist in moving the cutter assemblies in the proper direction. It will be noted that the guide sleeves 4 are inclined forwardly or to the front of the apparatus A while the lower ends of the cutter assemblies C are castered or angled to the rear. Also, the cutter assemblies are cambered or inclined to the center line so that the pair of cutter assemblies meets at a substantially vertical line passing through the center of the pipeline P as illustrated in FIG. 1 to cut a single trench T with the pair of cutter assemblies C. Furthermore, because of the angular relationship at which the cutter assemblies C are mounted, the pivotal movement of each cutter assembly C from the trench cutting position of FIG. 3 effects an outward swinging of each cutter assembly C away from the pipe P so as to spread them apart in their substantially horizontal or retracted position shown in FIG. 4. This effects the disposition of the cutter assemblies C away from the pipeline P to facilitate the initial positioning of the pipe crawler assemblies D on the pipeline at the beginning of each cutting operation on a particular pipeline. For removing the spoil or cuttings made by each of the cutter assemblies C, each assembly C has a lower spoil remover tube 50 which is connected to the base 31, or is formed integrally therewith and which has a spoil inlet opening 50*a* therewith into which the spoil enters for discharge upwardly through the discharge tube 50. A crumber 51 is welded or is otherwise secured to the pipe or tube 50 by any suitable means such as a retaining bracket 51*a* which is welded or is otherwise secured to both the crumber 51 and the pipe 50. The crumber 51 has an opening 51*b* in alignment with the opening 50*a* in the pipe 50.

The upper end of the tube 50 has a swing joint 50*b* connected to a curved elbow 50*c* and which in turn is connected to another swing joint 50*d* on a substantially U-shaped tubular spoil removal tube section 50*e*. Another swing joint 50*f* is provided to connect the section 50*e* to the intake pipe 16*a* to the centrifugal pump 16 for each cutter assembly C.

Since the tube 50 moves with the cutter assembly C as it is pivoted from its retracted position to its cutting position, and vice versa, the swing joints 50*b* and 50*d*, as well as 50*f* permit flexibility in the spoil removal tubes so as to enable the cutter assemblies C to move with substantially no restriction to and from the retracted and upright positions, while still maintaining the connection through the spoil removal tube to the centrifugal pump 16. The manner in which spoil removal tubes move can be readily seen from a comparison of FIGS. 2, 3 and 4 of the drawings.

As previously explained, it is desirable to have a jet at the upper end of each of the cutter blades 35 and this jetting fluid is supplied through the tubes 31 which are carried with the spoil removal tube 50. The upper ends of the tubes 31*b* are not illustrated, but they are of any flexible type to facilitate bending thereof during the movement of the cutter assembly C to and from its retracted and upright trenching positions. The jet tubes 52 are illustrated in various positions in FIGS. 9–11, with one of the tubes 52 being mounted inwardly of each cutting blade 35 and having a substantially right angle portion 52*a* at its upper end for the discharge of the jetting fluid therefrom in a direction to facilitate the cutting or digging action with the blades 35. The jetting fluid is supplied to the jet tubes 52 only from the chamber 30*b* so that jetting action takes place only from those jet nozzles 52*a* which are at the forward or side portions of the cutter assembly C as best seen in FIG. 9. The direction of rotation of the cutter assembly C is illustrated by the arrow R in FIG. 9. As previously explained, the opposite cutter assembly C rotates in the opposite direction so that they minimize any torque effects by reason of the rotation of the cutter assemblies C.

As best illustrated in FIG. 10, each cutter assembly C is castered or angled so that the lower end is trailing with respect to the upper end and so that substantially no portion of the cutting assembly is in contact with the bottom of the trench at the point of cutting action, except the cutter blades 35 themselves. By reason of such inclination of each cutter assembly C, the resistance to longitudinal forward movement of the cutter assemblies C is greatly reduced as compared to the prior art wherein the entire bottom portion of the cutter assembly C was normally engaged with the bottom of the trench as it was being cut. It should also be noted that each cutter assembly C is of a frusto-conical shape with the larger diameter being at the upper end and the angle of inclination towards the center line of the pipeline is as illustrated in FIG. 1 so that the outer circumference of the conical portion of each cutter assembly C is substantially vertical at the center line passing through the center of the pipeline P. The contoured strips 37 are shaped so that they are clear of the pipeline P at all times.

In the preferred form of the invention, an overburden cutter 60 is mounted forwardly of each cutter assembly C and it has any suitable jets or cutting means therewith for cutting the upper portion of the trench known as the overburden. Cutter blades 60*a* of any suitable construction are mounted on the cutter 60 and they are rotatably supported by a rotatable frame 60*b* relative to a support column 61. The support column is tubular and serves also as a spoil removing means, preferably utilizing a simple type of conventional pump internally of the pipe 61 at the tubular portion 61*a*, which pump is not illustrated in detail but which may be of any conventional eduction type with a special pump motor 61*b* usable therewith if so desired. In any event, the tube 61 is curved and is connected to the upper end of the housing 40 by a swing joint 61*c*. The power for rotating the overburdened cutter 60 is supplied by a drive connection from the main cutter assembly C through a chain 62 which is mounted on a sprocket 60*c* on the cutter 60 and a correpsonding sprocket 37*a* mounted on the contour strips 37 or any other suitable part of the cutter assembly C. Thus, as the cutter assembly C is rotated, the cutter 60 is likewise rotated by the chain drive 62.

Figure 4:
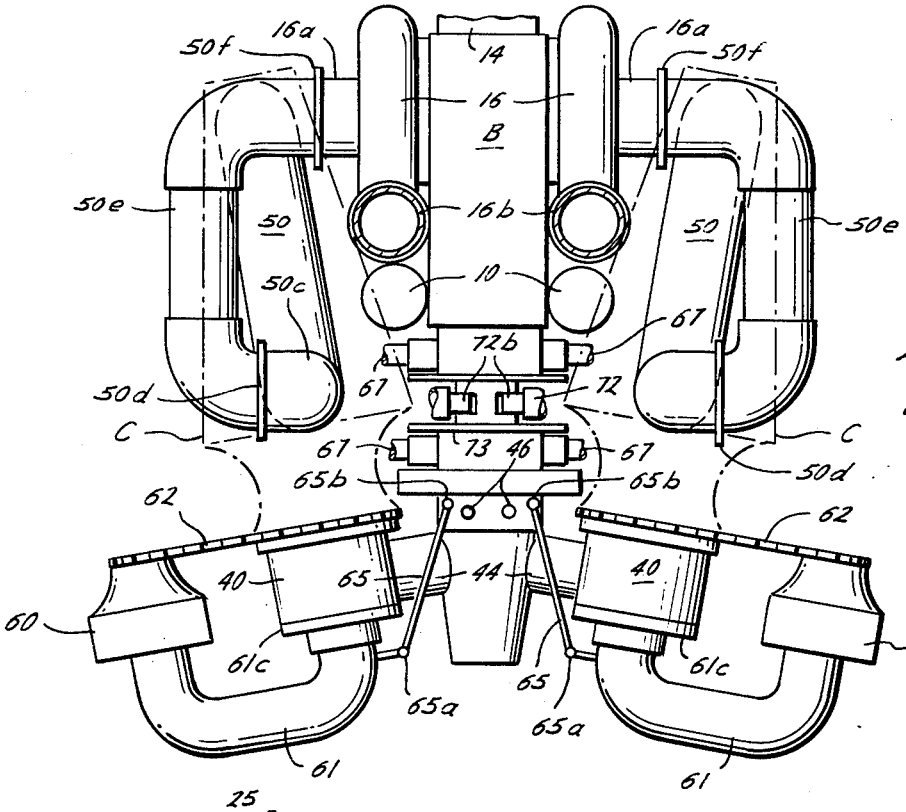
FIG. 4 is a plan view of the apparatus of FIGS. 1–3, showing the cutter assemblies in the retracted position prior to digging themselves into the cutting position of FIGS. 1–3.

When each cutter assembly C is in the substantially horizontal position of FIG. 4, the overburden cutter 60 therewith is likewise preferably in the substantially horizontal position as shown in FIG. 4, which is made possible because of the swing joint 61*c*, previously identified. To facilitate automatic swinging of the overburden cutters 60 from their substantially horizontal retracted position of FIG. 4 to their cutting position of FIGS. 2 and 3, control linkage is provided which includes a link arm 65 connected by a ball joint or universal connection 65*a* to the tube 61 and by another ball joint or universal connection 65*b* to the body B. Because the link arm 65 is of a fixed length, the swinging movement of the cutter assembly C therewith causes the cutter 60 to swing automatically to the positions indicated in the drawings. It will be appreciated that the cutters 60 may be moved into any desired position manually instead of using the automatic linkage 65, if so desired.

Considering now the stabilizing means S illustrated with the form of the invention shown in FIGS. 1–11, it can be seen that identical parts of the stabilizing assembly S are mounted on each side of the apparatus A and therefore, for the most part, a description of only one of the portions of the stabilizing assembly S is described hereinafter in detail. Thus, the portion of the stabilizing means S on the right as viewed in FIG. 1 includes a buoyancy tank 66 preferably in the shape of a sphere, which is suitably mounted on a pair of pivoted support members 67 and suitable gusset plates 67*a* welded or otherwise secured between the sphere 66 and the support members 67. The support members 67 are pivotally mounted to the body B at joints 67*b* (FIG. 2). The support members 67 are secured to an axle bracket 68 having a wheel 69 therewith which is adapted to rest upon the bottom G of the ocean or other body of water in which the trench T is being dug. An adjustable height standpipe 70 is mounted so that it extends into the interior of the sphere 66. Its upper and lower ends are open to the water in the ocean or other body of water in which the apparatus is mounted so that water may enter the sphere S and maintain a level that corresponds with the top end 70*a* of the standpipe 70. The area above the water 71 is a chamber 66*a* having air or other gas under pressure, corresponding to the pressure above the water at the depth at which the apparatus is located. The pressure in the chamber 66*a* is adjusted so that the water 71 in the sphere 66 will at all times be at the level of the upper end of the tube 70. The tube 70 is adjustable upwardly and downwardly by means of an adjustable nut 70*b* which is threaded or is otherwise secured to the standpipe 70 for effecting a raising or lowering of the standpipe 70 as desired to control the level of the water 71 in the sphere 66. The level of the water 71 in the sphere 66 determines the extent of buoyancy of such sphere 66 and thus determines the position at which the apparatus A is disposed, assuming that the opposite sphere 66 is adjusted accordingly, as will be more evident hereinafter. The details of the means for operating the nut 70 have been omitted since this may be done with conventional hydraulic equipment or it may be done manually. Preferably, a hydraulic motor is utilized for turning the nut 70*b* for adjusting the height of the standpipe 70 in the sphere 66 during operations.

Although the two spheres 66 may be mounted solely on their support arms 67 with the wheels 69, as heretofore explained, it is generally desirable to also connect a hydraulic system inlcuding a hydraulic cylinder 72 and a piston rod 72*a* therewith from a central plate 73 mounted on the body B. The cylinder 72 is pivotally connected to the plate 73 at a pivot point 72*b*, while the piston rod 72*a* is connected to a portion of the gusset 67*a* at pivot point 72*c*. The cylinders 72 are supplied with hydraulic fluid in the known manner for effecting a raising and lowering of the apparatus relative to the pipeline during the positioning thereof, particularly when initially positioning the pipe crawler assemblies D on the pipeline P. Thus, by extending the piston rods 72*a* on both sides of the plate 73, the body B is raised upwardly since the wheels 69 are on the bottom G. Similarly, by retracting or shortening the extent to which such rods 72*a* are extended, the body B and the cutter assemblies C therewith are lowered relative to the pipeline P when the wheels 69 are on the bottom G.

In the operation or use of the form of the invention shown in FIGS. 1–11, the apparatus is positioned on the pipeline P which is disposed underneath the body of water. At the time of the initial positioning of the apparatus A on the pipeline P, the pipeline P is laying on the bottom G. The cutter assemblies C are in the retracted substantially horizontal position and the overburden cutters 60 are likewise in the retracted substantially horizontal position of FIG. 4, assuming the overburden cutters 60 are also utilized.

The lower brackets 17*a* and 17*b* of each of the pipe crawler assemblies D are spread apart so that they can pass over the pipeline P. When the wheels 69 engage the bottom G, the elevation of the body B, as well as the crawler assemblies D may be adjusted by controlling the extension of the piston rods 72*a*, as previously explained. Thus, the piston rods 72*a* are adjusted to move the upper pair of rollers 18 into contact with the upper surface of the pipeline P, and then the cylinders 22 are actuated to move the lower bracket sections 17*a* and 17*b* into the closed position of FIG. 5, at which time a retaining pin or lock 17*e* is applied to hold the sections 17*a* and 17*b* together with the lower rollers 18 in engagement with the lower part of the pipeline P. The pin or lock 17*e* may automatically connect when the sections 17*a* and 17*b* are brought together in the position of FIG. 5, or such pin or lock 17*e* may be inserted by a diver manually if desired.

The pressure in the chamber 66*a* is adjusted, preferably prior to the lowering of the apparatus A to the bottom G so as to obtain the partial buoyancy desired in each of the spheres 66. The height of the upper end 70*a* of the stand pipe 70 in each spere 66 is also adjusted at the surface initially to provide such semi-buoyancy as desired.

With the clamping wheels 18 thus secured to the pipeline P, the power is then supplied to the cutter assemblies C and to the motors 46 for moving the cutter assemblies C from their substantially horizontal position along side the pipeline P, allowing them to dig their way down to the substantially upright position of FIGS. 1, 3 and 10. The overburden cutters 60, if used, move simultaneously with the cutter assemblies C from the retracted position of FIG. 4 to the cutting position of FIGS. 2 and 3, as previously explained.

The power supplied to the drive wheels 18 in either or both of the pipe crawler assemblies D then causes the entire apparatus A to be urged longitudinally along the pipeline P, the rate of travel of which depends upon the type of soil which is encountered and the rate of cutting action by the cutter assemblies C. During such cutting action, the spoil removal from each overburden cutter 60 passes through the pipe 61 and flows down into the area inwardly of the cutter assembly C therewith and out through the tube 50 together with the cuttings or spoil from each cutter assembly C. The discharge of the spoil is directed through the centrifugal pump 16 to the discharge tubes 16*b* which are preferably directed a substantial distance away from the apparatus A as illustrated in FIG. 1.

As the appartus A moves along the pipeline P, the trench T is formed below the pipeline P and therefore the pipeline P drops into the trench by reason of its own weight.

When the apparatus A reaches the end of its travel along the pipeline P, it may be readily removed from the pipeline P by reversing the motors 46 to cause the housings 40 to rotate in a counterclockwise direction as viewed in FIG. 3 thus to move the cutter assemblies C to the retracted position of FIG. 4. The overburden cutters 60 are likewise moved to the retracted position by reason of the link members 65, as previously explained. Thereafter, the pin or lock 17*e* is removed by a diver or by any other suitable means, and the cylinders 22 are actuated to open the bracket sections 17*a* and 17*b* so that the entire apparatus may then be lifted off of the pipeline P.

During the longitudinal travel of the apparatus A along the pipeline P, vertical undulations such as caused by irregularities in the concrete coating on the pipe and actual bends in the pipe of relatively large radius may occur. To enable the apparatus A to move vertically in response to such undulations, the vertical variations are detected by a follower wheel 75 (FIG. 7) which is connected so as to provide a hydraulic signal by opening or closing a hydraulic control valve 75*a* varying amounts, or by any other suitable hydraulic control means so as to supply hydraulic fluid to the cylinders 72 (FIG. 1). Thus, if the deviation detector wheel 75 detects a rise in the pipe, the valve 75*a* is actuated to direct hydraulic fluid to the cylinders 72 to cause the piston rods 72*a* to extend which exerts a force tending to pivot the arms 67 downwardly, but since the wheels 69 are on the ground G the result is that the body B and the rollers 18 are raised upwardly to center them and properly locate them at the proper elevation with respect to the pipeline P. As soon as such upward movement occurs, the roller 75 is returned to its normal position in engagement with the pipe P and thus returning the valve 75*a* to its normal position so as to dicontinue any further hydraulic action with respect to the cylinder 72. Should the pipeline drop some due to a bend or deviation, the opposite would occur so as to lower the body B and the cutters C therewith to reposition the wheels or rollers 18 for the proper elevation of the pipe P.

As previously explained, if there is any lateral bend in the pipeline P during the longitudinal travel of the apparatus A while cutting a trench T therebelow, the movement of the cylinders 24 causes a return of the body B to a position on top of the pipeline P, so as to maintain the cutters C vertically below the pipeline P and to prevent them from moving into the pipeline P or at an undesired angle with respect thereto.

Figures 12, 13:
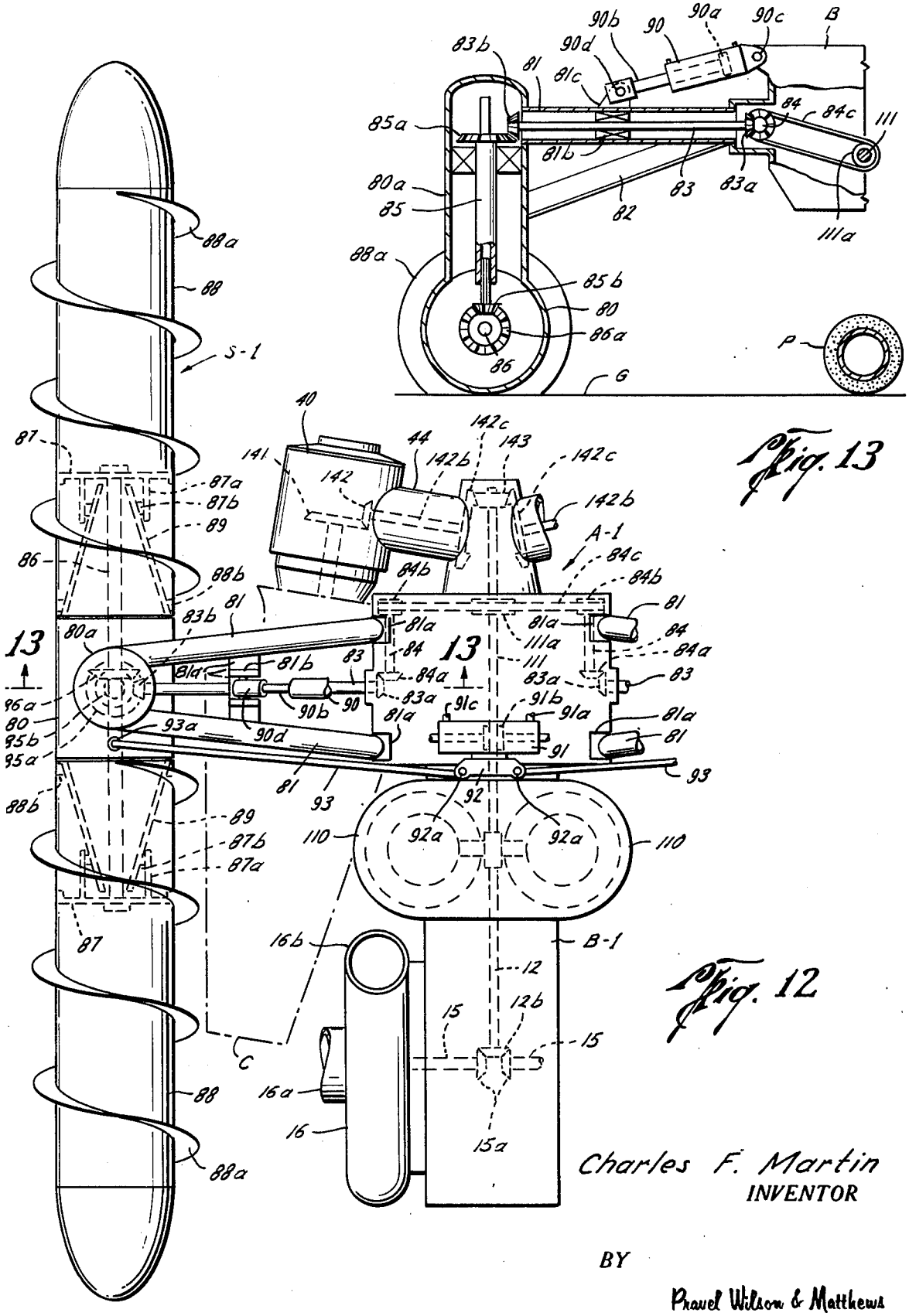
FIG. 12 is a plan view of a portion of a modified form of the apparatus of this invention.
FIG. 13 is a view taken on line 13—13 of FIG. 12.

In FIGS. 12 and 13, a modified form of the apparatus of FIGS. 1–11 is illustrated, with the principal changes being in the stabilizing means S-1 as compared to the stabilizing means S of FIGS. 1–11. Only one-half of the stabilizing means S-1 is illustrated since the other half is identical thereto, as will be understood.

The body B-1 of FIG. 12 is essentially the same as the body B of FIGS. 1–11, and the motors 110 are essentially the same as the motors 10, but the drive connection with the forward shaft 111 has been shown as modified as compared to that illustrated in FIGS. 1–11. However, it wil be understood that the drive assembly from the motors 110 to the shaft 111 may be identical to that illustrated in FIGS. 1–11. The centrifugal pumps 16, the cutter assemblies C and most of the other parts of the apparatus A-1 of FIGS. 12 and 13 are identical and bear the same numerals and/or letters for like parts. The arrangement of the gear drive from the drive shaft 111 to each cutter assembly C is illustrated somewhat differently in FIG. 12 as being from a gear 143 on the shaft 111 which is in engagement with a gear **142*c* driving a shaft 142*b* and gear 142 which engages gear 141, imparting rotation to the cutter assembly C in the same manner as described in connection with FIG. 8** in particular.

The stabilizing means S-1 is adapted to engage the bottom or ground G of the ocean or other body of water as illustrated in FIG. 13. Such stabilizing means S-1 includes a central tubular support member 80 which has a vertical housing **80*a* extending upwardly therefrom. The housing 80*a* is welded or is otherwise secured to pivoted arms 81 which are pivoted to the body B at 81*a*. Additional angular pivoted braces 82 (FIG. 13) may also be welded or otherwise secured to the housing 80*a* and pivoted with the pivoted support arms 81. A bearing support bracket 81*a* is welded or is otherwise connected between the pair of support arms 81 (FIG. 12) for receiving a bearing 81*b* through which a rotatable drive shaft 83 extends. The drive shaft 83 has a bevel gear 83*a* on its inner end in driving engagement with a gear 84*a* on a shaft 84 which has a sprocket 84*b* driven by a chain 84*c* from a sprocket 111*a* on the shaft 111. A bevel gear 83*b* is in driving engagement with a bevel gear 85*a* which drives a tubular shaft 85 connected by splines to a lower drive gear 85*b* which is in engagement with a bevel gear 86*a* on a drive shaft 86 extending through the central portion of the tubular support 80**.

The shaft 86 is connected to an internal framework support which includes a disk 87 disposed at each end of the shaft. Each disk 87 is welded or is otherwise secured in a hollow pipe or tube 88 having a helical crawler blade **88*a* welded or otherwise secured thereto. A bearing cone 89 is welded or is otherwise secured to each side of the central hub or member 80 and is fixed thereto so that such cones do not rotate or move except with the movements of the hub 80. On the inside of each of the crawler tubes 88, an annular bearing 88*b* of coventional construction is mounted for engagement with the external surface of the cone 89 so that the tubalar members 88 may rotate relative to the cones 89 and the hubs 80. An additional bearing support for each tubular member 88 is preferably provided by a bearing sleeve 87*a* which is welded or is otherwise secured to the plate 87 and which has a conventional bearing 87*b* in engagement with the external surface of the cone 89. Thus, bearings 87*b* and 88*b* provide longitudinally spaced bearing surfaces so that each of the tubular members 88 may rotate relative to the central hub 80. The rotation of such tubular members 88 is imparted thereto by the rotation of the shaft 86**, as previously explained.

A hydraulic system, including a cylinder 90, a piston **90*a* therein and a piston rod 80*b* are pivotally connected at 90*c* to the body B and at a pivoted connector 90*d* to the bearing bracket 81*c*. By controlling the fluid introduced into the cylinder 90, it will be evident that the piston rod 90*b* may be extended or retracted imparting a force to the body B tending to raise or lower same for centering the apparatus A-1 with respect to the pipe P in a manner similar to that described heretofore in connection with the cylinder 72 in the form of in invention shown in FIG. 1**.

In the event the pipeline P has lateral bends or deviations therein, the cylinders 24 are caused to move as heretofore described in connection with FIG. 5. Thus, if there is a left bend in the pipeline P viewing the pipeline from the rear of the apparatus, the piston rod **24*b* will tend to move into its cylinder 24 to shorten the distance between the pivot points 24*a* and 24*c* while the opposite piston rod 24*b* is extended. When this occurs, some of the fluid in the cylinder 24 which is displaced by the piston moving therein is transmitted to a hydraulic actuator 91 and is introduced through an inlet line 91*a* or other suitable means to move a piston or movable member 91*b* internally thereof a predetermined amount, which shifts an actuator head 92 with the piston 91*b* in the same direction as the piston 91*b*. Hydraulic fluid on the opposite side of the piston 91*b* is discharged through the tube 91*c* and it may return to the hydraulic cylinder 24 from which the fluid passed to the tube 91*a* so that the circuit is maintained complete. A universal or pivot connection 92*a* is provided on each side of the actuator 92 for pivotally connecting actuator rods 93 thereto at a pivotal joint 93*a* on the hub 80 of each of the bottom crawler assemblies S-1. Thus, both of the crawler assemblies S-1 are moved in the same direction and the same amount simultaneously, pivoting about the differential gearing 85*a*, 83*b* so that the crawler assemblies S-1 remain parallel to each other and are then in a different direction which causes the entire apparatus A-1 to change to the new direction which is likewise in the direction of the bend of the pipe P. When the pressure in the cylinder 24 which supplied the hydraulic fluid to the actuator 91 is thus relieved by the straightening of the apparatus to a substantially vertical position again, the hydraulic fluid then returns to the actuator 91 through the inlet tube 91*c* to return the piston 91*b*** to its substantially central position to thereby move the crawler assemblies S-1 back to a substantially central position until another lateral bend or change in the direction of the pipeline P occurs, at which time a similar, or opposite, change is produced in the crawler assemblies S-1 to again position the apparatus A-1 in alignment with the central axis of the pipeline P, thus maintaining the cutter assemblies C properly positioned in their upright position below the pipeline P and substantially vertically aligned as illustrated in FIG. 1 with the central axis of the pipeline P at all times.

In FIGS. 14 and 15, a modification is illustrated wherein the spoil removal means is modified by including a pair of screw conveyors 95 in a modified form of the tube 150 which corresponds generally with the tube 50 heretofore described in connection with FIGS. 1–11 and particularly FIG. 10. Suitable power means is provided from the surface or from the apparatus A itself to rotate the screw conveyors 150 to supplement the suction provided by the centrifugal pump 16 in the removal of the spoil which is cut from the bottom to form the trench below the pipeline P.

In FIGS. 16–18, a modified cutter assembly C-1 is illustrated wherein a plurality of jets 135 are utilized for the cutting action exclusively rather than using the cutter blades 35 of the cutter assemblies C. Although FIGS. 16–18 show a specific special arrangement for the mounting of the modified cutter assembly C-1, it should be understood that the cutter assembly C-1 could be substituted in place of either or both of the cutter assemblies C illustrated in FIGS. 1–12.

The cutter assembly C-1 has a central tubular support 129 which may have any suitable means for supporting same in the inclined position illustrated in FIGS. 16 and 17. For example, the lower end of the support 129 may be rotatably mounted on a base such as the base 31 of FIG. 10. The jet fluid which may be water is supplied through an inlet or supply tube 131 which is connected to any suitable source of water or fluid under pressure. The tube 131 extends downwardly through the full length of the support 129 so as to fill the bore thereof. A shield 151 corresponding to the shield 51 is disposed internally of the support pipe 129 so that the jetting fluid is supplied only to the jets 135 which are forwardly and to the side of the cutter assembly C-1, where the cutting action is taking place in the digging of the trench. The water flows outwardly from the bore of the tubular member 129 through hollow support pipes 135*a* to the jet nozzles 135 which are circumferentially spaced at different elevations and in a generally conical relationship with the smaller diameter being at the bottom and the larger diameter being at the top, corresponding generally to the configuration of the cutter assembly C.

For the spoil removal, it is desirable to locate the intake to the centrifugal pump 16 at a point above the cutter assembly C-1 since the jet nozzles 135 tend to wash and blow the solids upwardly with the water where they can be picked up by the overhead spoil removal pipe 150 which is curved to fit over the pipeline P with its open lower end 150*a* in position to receive the spoil. The centrifugal pump 16 is connected to the spoil removal pipe 150 in the same manner as described heretofore in connection FIGS. 1–12. The location of the centrifugal pump 16 in FIGS. 16 and 17 is somewhat schematic, but it will be understood that it will be mounted and positioned basically as shown in FIGS. 2 and 3 of the drawings. The tube 129 is rotated together with the jets 135 by any suitable means. For example, an annular gear 129*a* may be mounted on the tube 129 and it may be driven in essentially the same manner as the gear 41 is driven by the gear 42 as heretofore described. It should also be understood that the bearing mounting for the upper end of the tube 129 may be essentially in a bearing support housing such as the housing 40 of FIG. 8. Swing joints are not illustrated in the tube 150, but they may be incorporated therein for swinging movement of the cutter assembly C-1 in a manner described heretofore in connection with the cutter assembly C.

It should also be understood that the use of jets may be accomplished by simply substituting the jets 135 for the blades 35 in the form of the invention particularly illustrated in FIGS. 1–11. In such case, the apparatus would not necessarily have the spoil remover tube 150 disposed above the pipeline P in the overhead position as illustrated in FIGS. 16 and 17, but instead the same support assembly and spoil remover tube 50 would be utilized. The supply of fluid to the jets 135 could be accomplished in that instance with the tube 131 through the tubes 31*b* as heretofore described, but providing the communication throughout the full length of the full length of the housing 129 so that all of the jets 135 are supplied with the fluid.

The foregoing disclosure and description of the invention are illustrative and explanatory thereof, and various changes in the size, shape, and materials as well as in the details of the illustrated construction may be made without departing from the spirit of the invention.

I claim:

1. Submarine pipeline trenching apparatus, comprising:

a trench cutter assembly;

a support body adapted to extend longitudinally above a pipeline;

pipe crawler means connected to said body and engageable with the pipeline for imparting longitudinal movement to said body and said cutter assembly; and cutter positioning means operably connected with said cutter assembly for moving said cutter assembly from a raised substantially horizontal position substantially alongside the pipeline to an upright position below the pipeline after said crawler means is positioned on the pipeline.

2. The structure set forth in claim 1, including:

cutter power means for rotating said cutter assembly about its own axis for digging said assembly into said upright position as it is moved by said cutter positioning means and for thereafter cutting a trench below the pipeline as said assembly is moved longitudinally by said pipe crawler means.

3. The structure set forth in claim 2, including:

another trench cutter assembly, with the assemblies mounted on opposite sides of said body for positioning on opposite sides of the pipeline and for co-acting together in their upright position to cut a single trench below the pipeline; and each of said cutter assemblies being disposed in said upright position at an angle to the direction of longitudinal travel thereof, with the upper end leading the lower end, whereby only a portion of the lower end is in contact with the bottom of the trench being cut to minimize resistance to movement of the cutter assemblies as they progress longitudinally during their cutting action.

4. The structure set forth in claim 3, wherein each of said cutter assemblies includes:

cutter blades for cutting the trench during the rotation thereof about the axis of said assembly.

5. The structure set forth in claim 3, wherein each of said cutter assemblies includes:

a plurality of jet nozzles disposed at different elevations from the upper end to the lower end of the assembly, and with at least one jet nozzle at each of said elevations.

6. The structure set forth in claim 1, wherein said pipe crawler means includes:

a pair of pipe crawler assemblies spaced longitudinally with respect to each other and each of which is separately attached to said body; and crawler power means for driving at least one of said crawler assemblies for imparting longitudinal movement of said apparatus along the pipeline.

7. The structure set forth in claim 6, wherein each pipe crawler assembly includes:

a pair of upper rollers adapted to seat upon the upper portion of the pipeline;

a pair of lower rollers adapted to engage the lower portion of the pipeline; and releasable clamp means mounting said lower rollers which is adapted to open to a width for passing the lower rollers over the pipeline and then is adapted to close to a clamped position for the engagement of the lower rollers with the pipeline.

8. The structure set forth in claim 1, including:

stabilizing means connected to said body and extending outwardly to each side of the pipeline for engaging the bottom of the body of water to maintain said cutter assembly substantially upright at all times while digging the trench below the pipeline.

9. The structure set forth in claim 1, including:

spoil removal menas disposed rearwardly of said cutter assembly and movable therewith from said raised position to said upright position for picking up spoil cut by said cutter assembly for the discharge of same away from the trench being cut by the cutter assembly.

10. The structure set forth in claim 1, including:

an overburden cutter means mounted with said cutter assembly and disposed in its position above and forwardly of the upper end thereof for assisting the cutter assembly in cutting away soil at the upper end of the trench to thereby reduce the load on the cutter assembly.

11. The structure set forth in claim 10, including: means for moving said overburden cutter means from a retracted substantially horizontal position to said cutting position.

12. Submarine pipeline trenching apparatus, comprising:

a trench cutter assembly;

a support body adapted to extend longitudinally above a pipeline;

pipe crawler means connected to said body and engageable with the pipeline for imparting longitudinal movement to said body and said cutter assembly;

cutter positioning means for moving said cutter assembly from a raised position substantially alongside the pipeline to an upright position below the pipeline after said crawler means is positioned on the pipeline;

said pipe crawler means including a pair of pipe crawler assemblies spaced longitudinally with respect to each other and each of which is separately attached to said body, crawler power means for driving at least one of said crawler assemblies for imparting longitudinal movement of said apparatus along the pipeline;

each said pipe crawler assembly including a pair of upper rollers adapted to seat upon the upper portion of the pipeline, a pair of lower rollers adapted to engage the lower portion of the pipeline, and releasable clamp means mounting said lower rollers which is adapted to open to a width for passing the lower rollers over the pipeline and then is adapted to close to a clamped position for the engagement of the lower rollers with the pipeline; each of said upper and lower rollers being mounted for pivotal movement in a substantially radial direction with respect to the pipeline; and including:

torque means for applying a predetermined torque to each of said rollers urging same substantially radially inwardly but yieldable for enabling said wheels to follow and maintain rolling contact with the pipeline even though lateral bends or vertical undulations in the pipeline are encountered by said rollers as they are moved longitudinally along the pipeline.

13. Submarine pipeline trenching apparatus, comprising:

a trench cutter assembly having a lower end and an upper end and a plurality of cutter elements extending from its lower end upwardly to near its upper end;

a support body adapted to extend longitudinally above a pipeline;

pipe crawler means connected to said body and engageable with the pipeline for imparting longitudinal movement to said body and said cutter assembly;

cutter power means for rotating said cutter assembly and said cutter elements thereof about the axis of the cutter assembly generally transverse to said longitudinal movement of said body when said cutter assembly is in an upright position for digging a trench below said pipeline to receive same; and said cutter assembly being disposed in said upright position at an angle to the direction of longitudinal travel thereof, with the upper end leading the lower end, and with the cutter elements at the lower end cutting the soil to form the lower part of a trench whereby only a portion of the lower end is in contact with the bottom of the trench being cut to minimize resistance to the movement of the cutter assembly as it progresses longitudinally during its cutting action.

14. The structure set forth in claim 13, wherein said cutter assembly includes:

a base upon which said cutter assembly is supported and rotates relative thereto while said cutter blades are cutting the trench during the rotation thereof about the axis of said assembly; and said base being disposed substantially horizontally for sliding relative to the bottom while the cutter blades at the lower end cut ahead thereof.

15. The structure set forth in claim 13, wherein said cutter assembly includes:

a jet nozzle disposed with each of said cutter blades for discharging fluid at high velocity at the upper end of each of said cutter blades.

16. Submarine pipeline trenching apparatus, comprising:

a trench cutter assembly;

a support body adapted to extend longitudinally above a pipeline;

pipe crawler means connected to said body and engageable with the pipeline for imparting longitudinal movement to said body and said cutter assembly;

cutter power means for rotating said cutter assembly about its own axis generally transverse to said longitudinal movement of said body when said cutter assembly is an upright position for digging a trench below said piepline to receive same;

said cutter assembly being disposed in said upright position at an angle to the direction of longitudinal travel thereof, with the upper end leading the lower end, whereby only a portion of the lower end is in contact with the bottom of the trench being cut to minimize resistance to the movement of the cutter assembly as it progresses longitudinally during its cutting action;

another cutter assembly, with the assemblies mounted on opposite sides of said body for positioning on opposite sides of the pipeline and for co-acting together in their upright position to cut a single trench below the pipeline; and each of said assemblies being generally frusto-conical in shape, with the upper end of a larger diameter than the lower end, and with the assemblies being inclined towards a substantially vertical axis extending through the pipeline.

17. Submarine pipeline trenching apparatus, comprising:

a trench cutter assembly;

a support body adapted to extend longitudinally above a pipeline;

pipe crawler means connected to said body and engageable with the pipeline for imparting longitudinal movement to said body and said cutter assembly; and stabilizing means connected to said body and extending outwardly to each side of the pipeline for engaging the bottom of the body of water to maintain said cutter assembly substantially upright at all times while digging the trench below the pipeline, said stabilizing means including:

a semi-buoyant tank on each side of the pipeline;

a wheel below and mounted with each of the tanks for engagement with the bottom of the body of water; and means for adjusting the buoyancy of said tanks to adjust the position thereof and the body and the cutter assembly therewith for maintaining said cutter assembly in its substantially upright position below the pipeline.

18. Submarine pipeline trenching apparatus, comprising:

a trench cutter assembly;

a support body adapted to extend longitudinally above a pipeline;

pipe crawler means connected to said body and engageable with the pipeline for imparting longitudinal movement to said body and said cutter assembly; and stabilizing means connected to said body and extending outwardly to each side of the pipeline for engaging the bottom of the body of water to maintain said cutter assembly substantially upright at all times while digging the trench below the pipeline, said stabilizing means including:

a bottom crawler member disposed on each side of the pipeline and engageable with the bottom of the body of water for longitudinal movement substantially parallel to the pipeline; and means for changing the directions of movement of said crawler members in response to lateral bends in the pipeline to maintain said cutter assembly in its substantially upright position below the pipeline while digging the trench below the pipeline.

19. Submarine pipeline trenching apparatus, comprising:

a trench cutter assembly;

a support body adapted to extend longitudinally above a pipeline;

pipe crawler means connected to said body and engageable with the pipeline for imparting longitudinal movement to said body and said cutter assembly; and stabilizing means connecting to said body and extending outwardly to each side of the pipeline for engaging the bottom of the body of water to maintain said cutter assembly substantially upright at all times while digging the trench below the pipeline, said stabilizing means including:

means for detecting vertical undulations of the pipeline; and means for effecting a vertical displacement of said cutter assembly to maintain the same relative vertical position of said cutter assembly with respect to the centerline of the pipeline at all times while digging the trench below the pipeline.

20. Submarine pipeline trenching apparatus, comprising:

a trench cutter assembly;

a support body adapted to extend longitudinally above a pipeline;

pipe crawler means connected to said body and engageable with the pipeline for imparting longitudinal movement to said body and said cutter assembly; and stabilizing means connected to said body and extending outwardly to each side of the pipeline for engaging the bottom of the body of water to maintain said cutter assembly substantially upright at all times while digging the trench below the pipeline, said stabilizer means including:

means for detecting lateral bends in the pipeline; and means for effecting a shifting of said cutter assembly to maintain same in said upright position.

21. Submarine pipeline trenching apparatus comprising:

a trench cutter assembly;

a support body adapted to extend longitudinally above a pipeline;

pipe crawler means connected to said body and engageable with the pipeline for imparting longitudinal movement to said body and said cutter assembly; and stabilizing means connected to said body and extending outwardly to each side of the pipeline for engaging the bottom of the body of water to maintain said cutter assembly substantially upright at all times while digging the trench below the pipeline, said stabilizing means including:

means for detecting vertical undulations of the pipeline;

means for effecting a vertical displacement of said cutter assembly to maintain the same relative vertical position of said cutter assembly with respect to the centerline of the pipeline at all times while digging the trench below the pipeline;

means for detecting lateral bends in the pipeline; and means for effecting a shifting of said cutter assembly to maintain same in said upright position.

22. An underwater trenching apparatus for burying a pipeline or the like beneath the bottom of a body of water comprising: a frame for positioning over the pipeline to be buried; jet means supported by said frame, comprising a plurality of vertically arranged nozzles for digging a trench in said bottom for burying said pipeline; eductor means supported by said frame for drawing up portions of said bottom cut by said jet means and discharging these portions away from said apparatus; a set of rollers secured to said frame and contacting said pipeline to direct said apparatus along said pipeline; drive means to drive at least one roller of said set of rollers for movement of said apparatus along said pipeline; and resilient means operable between said one roller of said set and said frame to permit movement of said one roller toward and away from the axis of said pipeline while following variations in circumference in said pipeline.

23. The apparatus of claim 22 including each said one roller being rotatably mounted on an arm pivotally secured to said frame and said resilient means being positioned in contact with said arm and said frame to operatively control the position of said arm and maintain the said one roller in contact with said pipeline.

24. The apparatus of claim 22 wherein said nozzles are supported on a rotatable nozzle supporting means, said nozzle supporting means being rotatable in a direction generally transverse to the direction of movement of said body along said pipeline.

25. The apparatus of claim 24 wherein there are a plurality of circumferentially disposed nozzles spaced at varying elevations.

26. The apparatus of claim 25 further including means for selectively supplying jetting fluid to the forward most and side nozzles of said circumferentially spaced nozzles.

27. An underwater trenching apparatus for burying a pipeline or the like beneath the bottom of a body of water comprising: a frame for positioning over the pipeline to be buried:

jet means supported by said frame, comprising a plurality of vertically arranged nozzles for digging a trench in said bottom for burying said pipeline;

eductor means supported by said frame for drawing up portions of said bottom cut by said jet means and discharging these portions away from said apparatus;

a set of rollers secured to said frame and contacting said pipeline to direct said apparatus along said pipeline;

resilient means positioned between at least one of said rollers and said frame to permit movement of said roller toward and away from the axis of said pipeline while following variations in circumference in said pipeline; and including a ballast tank support superposed upon said frame, a ballast tank mounted on each side of said tank support and said pipeline.

28. The apparatus of claim 27 wherein said nozzles are supported on a rotatable nozzle supporting means, said nozzle supporting means being rotatable in a direction generally transverse to the direction of movement of said body along said pipeline.

29. The apparatus of claim 28 wherein there are a plurality of circumferentially disposed nozzles spaced at varying elevations.

30. The apparatus of claim 29 further including means for selectively supplying jetting fluid to the forward most and side nozzles of said circumferentially spaced nozzles.

31. An underwater trenching apparatus for burying a pipeline or the like beneath the bottom of a body of water comprising:

a frame for positioning over the pipeline to be buried;

jet means supported by said frame, comprising a plurality of vertically arranged nozzles for digging a trench in said bottom for burying said pipeline;

a set of rollers secured to said apparatus and contacting said pipeline to direct said apparatus along said pipeline, drive means to drive at least one of said first rollers for movement of said apparatus along said pipeline;

resilient means positioned between aat least one of said rollers and said frame to permit movement of said roller toward and away from the axis of said pipeline while following variations in the circumference in said pipeline.

32. The apparatus of claim 31 wherein said nozzles are supported on a rotatable nozzle supporting means, said nozzle supporting means being rotatable in a direction generally transverse to the direction of movement of said body along said pipeline.

33. The apparatus of claim 32 wherein there are a plurality of circumferentially disposed nozzles spaced at varying elevations.

34. The apparatus of claim 33 further including means for selectively supplying jetting fluid to the forward most and side nozzles of said circumferentially spaced nozzles.

35. An underwater trenching apparatus for burying a pipeline or the like beneath the bottom of a body of water comprising:

a frame for positioning over the pipeline to be buried;

jet means supported by said frame, comprising a plurality of vertically arranged nozzles for digging a trench in said bottom for burying said pipeline, said jet means being the sole means for digging the trench;

eductor means supported by said frame for drawing up portions of said bottom cut by said jet means and discharging these portions away from said apparatus;

a first set of rollers secured to said apparatus and contacting said pipeline to direct said apparatus along said pipeline;

drive means to drive at least one roller of said first set of rollers for movement of said apparatus along said pipeline; and resilient means operable between said one roller of said first set and said apparatus to permit movement of one roller toward and away from the axis of said pipeline while following variations in circumference in said pipeline.

36. The apparatus of claim 35 wherein said nozzles are supported on a rotatable nozzle supporting means, said nozzle supporting means being rotatable in a direction generally transverse to the direction of movement of said body along said pipeline.

37. The apparatus of claim 36 wherein there are a plurality of circumferentially disposed nozzles spaced at varying elevations.

38. The apparatus of claim 37 further including means for selectively supplying jetting fluid to the forward most and side nozzles of said circumferentially spaced nozzles.

* * * * *

UNITED STATES PATENT AND TRADEMARK OFFICE

CERTIFICATE OF CORRECTION

PATENT NO. : 4,022,028

DATED : May 10, 1977

INVENTOR(S) : Charles F. Martin

It is certified that error appears in the above-identified patent and that said Letters Patent are hereby corrected as shown below:

In Column 4, line 28, delete the word "precision" and insert therefor --piston--.

In Column 6, line 32, delete the number "4" and insert therefor the number--44--.

In Column 9, line 64, delete the word "spere" and insert therefor --sphere--.

In Column 13, line 57, after the word "connection" insert the word --with--.

In Column 14, line 18, delete the phrase "of the full length" in the second occurance.

In Claim 9, line 31, delete the word "menas" and insert therefor --means--.

UNITED STATES PATENT AND TRADEMARK OFFICE

CERTIFICATE OF CORRECTION

PATENT NO. : 4,022,028
DATED : May 10, 1977
INVENTOR(S) : Charles F. Martin

It is certified that error appears in the above-identified patent and that said Letters Patent are hereby corrected as shown below:

cont'd.

In Claim 19, line 17, delete the word "connecting" and insert therefor --connected--.

In Claim 31, line 20, delete the word "aat" and insert therefor --at--.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*